United States Patent [19]

Evans

[11] 4,178,721

[45] Dec. 18, 1979

[54] APPARATUS FOR SIZING AND FINISHING BATCHES OF LUMBER

[75] Inventor: F. David Evans, Eugene, Oreg.

[73] Assignee: Kimwood Corporation, Cottage Grove, Oreg.

[21] Appl. No.: 865,218

[22] Filed: Dec. 28, 1977

[51] Int. Cl.[2] ..... B24B 21/04

[52] U.S. Cl. ..... 51/139; 51/140; 144/1 R; 144/326 R

[58] Field of Search ..... 51/5 A, 5 B, 5 C, 3, 51/80 A, 81 R, 135 R, 137, 138, 139, 140, 326, 328; 144/3 R, 39, 116, 176, 326 R, 1 R

[56] References Cited

U.S. PATENT DOCUMENTS

| | | | |
|---|---|---|---|
| 590,836 | 9/1897 | Hayes | 57/5 C |
| 1,927,330 | 9/1933 | Williams | 51/138 |
| 3,074,210 | 1/1963 | Eschenburg et al. | 51/138 |
| 3,169,352 | 2/1965 | Smith | 51/140 |
| 3,541,735 | 11/1970 | Schaller et al. | 51/139 |
| 3,701,219 | 10/1972 | Sternal | 51/140 |

*Primary Examiner*—Harold D. Whitehead
*Assistant Examiner*—Robert P. Olszewski
*Attorney, Agent, or Firm*—Kolisch, Hartwell, Dickinson & Stuart

[57] ABSTRACT

An apparatus for sizing and finishing batches of lumber including a sizing station and a finishing station. The sizing station includes at least one pair of opposed, power-driven belt abraders operable for dimensionally sizing the lumber to a predetermined thickness by abrading opposed, first and second lumber faces. The finishing station includes additional belt abraders which are staggered on opposite sides of the path of lumber conveyance.

3 Claims, 1 Drawing Figure

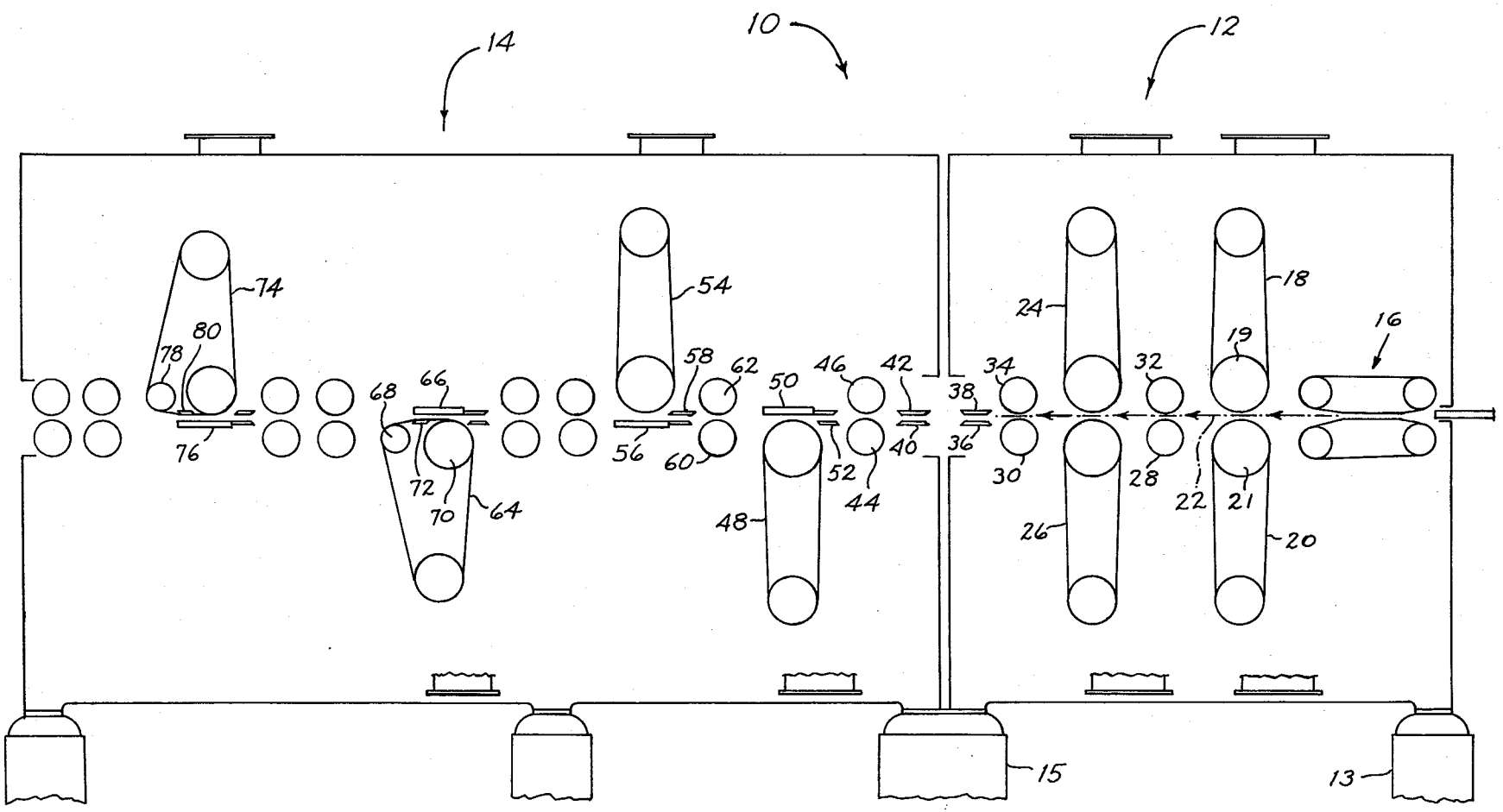
10
12
13
14
15
16
18
19
20
21
22
24
26
28
30
32
34
36
38
40
42
44
46
48
50
52
54
56
58
60
62
64
66
68
70
72
74
76
78
80

APPARATUS FOR SIZING AND FINISHING BATCHES OF LUMBER

BACKGROUND AND SUMMARY OF THE INVENTION

The present invention relates to lumber finishing apparatus, and more particularly to a novel belt sanding apparatus for sizing and finishing batches of lumber.

In the surface finishing of rough-sawn lumber, it is known to convey the lumber through rotating knife planer heads for finishing the lumber. The knife planer heads may be positioned on opposite sides of a path of conveyance for finishing opposite faces of the lumber. However, construction of an apparatus for finishing lumber using knife planer heads is expensive. Additionally, maintenance of individual knife blades is time consuming and expensive because the blades must be periodically removed, sharpened and replaced.

While it has been proposed to finish lumber using abrasive belt sanders rotatably mounted by means of a driven contact drum or roll, the use of such sanders has been directed to finishing only after knife planer heads have dimensionally sized the lumber to a predetermined thickness. Additionally, the abrasive belt of the sander includes a splice which is raised somewhat above the surface of the belt thereby causing a splice mark on the lumber as it is sanded. As lumber is conveyed through a belt sander, the splice marks produce a so-called "ripple" which is undesired in a finished product. Additionally, the belt will produce undesirable contact roll revolution marks.

Accordingly, it is a general object of the present invention to provide an apparatus for sizing and finishing batches of lumber which includes a sizing station and a finishing station. More specifically, the sizing station includes a pair of opposed, power-driven belt sanders for receiving and sanding opposite surfaces of lumber so that the lumber exits from the sizing station with a predetermined thickness.

Another object of the present invention is to construct the finishing station with staggered belt sanders. This is known as a "staggered head" sander and refers to positioning of belt sanders on opposite sides of the path of lumber conveyance wherein one belt sander is positioned downstream from the other.

Still another object of the present invention is to construct the sizing station with additional opposed belt sanders for receiving batches of lumber after they have been conveyed through the first pair of opposed belt sanders. Thus, it is possible to eliminate knife planer heads for dimensionally sizing the thickness of batches of lumber by providing two pairs of opposed belt sanders which successively abrade or sand the lumber to a predetermined thickness.

These and additional objects and advantages of the present invention will be more particularly appreciated after a consideration of the drawings and the detailed description of the preferred embodiment.

BRIEF DESCRIPTION OF THE DRAWING

The drawing is a schematic, side elevation view of a lumber sizing and finishing apparatus according to the present invention illustrating a sizing station positioned in advance of a finishing station, the lumber being conveyed from right to left.

DETAILED DESCRIPTION OF THE PREFERRED EMBODIMENT

Turning to FIG. 1 of the drawing, a planing apparatus for sizing and finishing batches of lumber is generally indicated at 10. Apparatus 10 includes a sizing station indicated at 12 which preceeds, considering the direction of lumber feed, a finishing station indicated at 14. Apparatus 10 is elevated above a ground surface by means of a plurality of suitably positioned foundation piers 13, 15, etc.

Sizing station 12 is provided for receiving batches of lumber such as individual boards which may be positioned side by side for a width upwardly of, for instance, 50 inches. Specifically, a feeding mechanism such as described in U.S. Pat. No. 3,915,290 and generally indicated at 16, may be provided for conveying lumber to the left. Positioned downstream of feeding mechanism 16 is a first pair of opposed, power-driven belt abraders or sanders 18, 20. Belt sanders 18, 20 are positioned on opposite sides of a path of conveyance indicated at 22 which corresponds to a preselected datum plane which is equidistant between opposed faces of the lumber. Each belt sander 18, 20 includes a conventional contact drum such as indicated at 19, 21, respectively and is suitably mounted in the sizing station.

Positioned downstream of belt sanders 18, 20 are a second pair of opposed, power-driven belt sanders 24, 26. The contact drums of belt sanders 24, 26 are positioned closer to datum plane 22 so that additional material may be planed off of the opposite faces of the lumber as it is passed therethrough. Further, it is to be noted that power-driven feed rollers are indicated at 28, 30 and are positioned behind the first and second pair of belt sanders, respectively as illustrated. Pinch rollers 32, 34 are associated with feed rollers 28, 30, respectively. Also, it is to be noted that a pair of opposed guide plates 36, 38 are positioned behind feed and pinch rollers 30, 34 for guiding batches of sized lumber from sizing station 12 to finishing station 14.

Thus, it can be seen that a sizing sequence will involve a method wherein batches of lumber, such as rough-sawn kiln dried lumber, are delivered between belt sanders 18, 20 for dimensionally sizing the lumber to a predetermined thickness by simultaneously abrading directly opposed areas on the opposite faces of the lumber. The lumber is then conveyed by feed and pinch rollers 28, 32 to downstream belt sanders 24, 26 which are operable for dimensionally planing or sizing the lumber to second predetermined thickness by planing the opposite faces of the lumber. The lumber is then delivered by means of feed and pinch rollers 30, 34 through guide plates 36, 38 into finishing station 14.

The purpose of finishing station 14 is twofold, namely: (1) to "true up" the lumber and (2) to eliminate contact roll revolution and splice marks from the faces of the lumber. Specifically, and as stated previously, each of the belts entrained by a contact drum are secured at their opposite ends by means of a splice. The splice extends outwardly somewhat and produces a so-called "ripple" on the face of the lumber being planed. Additionally, lumber may not have a substantially straight surface profile, when viewed in profile, but rather may wave or "snake".

With the above problems in mind, the provision of finishing station 14, according to the construction of the present invention, finds particular utility. Specifically, lumber is guided into finishing station 14 between a pair of opposed guide plates 40, 42 and is delivered by means of a pair of drive and pinch rollers 44, 46 into a first power-driven belt sander 48 operable for pre-finishing a first lumber face. A rigidly positioned support platen 50 is presented oppositely to belt sander 48 for contact against the opposite or second lumber face. A hold-down shoe is indicated at 52. Thus, as the lumber is guided over platen 50, belt sander 48 pre-finishes the first or lower lumber face so that it is trued. This means that any waves or "snakes" in the lumber are substantially eliminated by virtue of the fact that the second lumber face is held rigidly against platen 50 during sanding or planing of the first lumber face as the lumber is conveyed downstream.

Similarly, another or second belt sander 54, located downstream of belt sander 48, is positioned oppositely an associated platen 56. A hold-down shoe is indicated at 58 and as lumber is conveyed from belt sander 48 by means of a pair of drive and pinch rollers 60, 62, respectively, the first lumber face is urged against platen 56 and the second lumber face is pre-finished. Thus, the lumber is trued-up on the other side.

At this point, the lumber is substantially trued-up but still includes ripples on both its faces due to contact roll revolution marks as well as splice marks from the belt splices.

In order to remove the ripples, it is necessary to convey the lumber to a pair of additional, downstream and staggered belt sanders. As illustrated, a third power-driven belt sander 64 is positioned for planing the first lumber face and is mounted oppositely to a rigidly mounted platen 66. Belt sander 64 is provided with an idler roll 68 positioned downstream of a contact drum 70 mounted for driving the belt sander. A flexible platen is shown at 72 and permits the belt of belt sander 64 to flex somewhat when the aforementioned ripples are encountered. Thus, belt sander 64 planes the first lumber face and substantially removes its rippled surface to thereby provide a final finish.

Positioned downstream of belt sander 64 is a fourth or final belt sander 74 which is positioned opposite a rigidly mounted platen 76 for planing the second lumber face. An idler roll is shown at 78 and a flexible platen at 80. As illustrated schematically, additional sets of drive and pinch rollers are interposed between the belt sanders for continuously feeding the lumber downstream for eventual exit from finishing station 14.

From the above, it is to be noted that belt sanders 64, 74 provide a so-called final finish to the first and second lumber faces after the lumber has been sized and trued. Thus, rough-sawn lumber is sized, prefinished and finally finished in apparatus 10 without the use of knife planer heads.

Finishing station 14 is referred to as a "four-head" staggered finishing machine. The apparatus in its entirety, may be referred to as an "eight-head" abrasive planer or sander. It is to be noted that each of the belt sanders in finishing station 14 are vertically positionable or adjustable for setting at a preselected distance from its opposed platen or for positioning it out of the way for non contact with a lumber face. While the opposed belt sanders in sizing station 12 accurately size rough-sawn kiln dried lumber to a predetermined thickness contact roll revolution marks and belt splice marks remain which must be removed, after trueing of the lumber, by staggered and opposed belt sanders 64, 74. The staggered configuration permits the removal of more material from one face of the lumber than another if desired. Also, it is also possible to cam or position any one of the belt sanders completely out of the way from contact with a lumber face.

Another advantage of the present invention resides in the fact that with the staggered arrangement in finishing station 14, it is possible to provide the belt sanders with different sanding belts, i.e. belts of different abrasive grits. This would be advantageous in the situation requiring one lumber face to have a smoother or different finish than the other lumber face, for example. If fine abrasive belts, such as 80 or 100 grit are to be used, they must be mounted on a contact drum associated with a flexible platen.

While the invention has been particularly shown and described with reference to the foregoing preferred embodiment, it will be understood by those skilled in the art that other changes in form and detail may be made within the spirit and scope of the invention as defined in the appended claims.

It is claimed and desired to secure by Letters Patent:

1. Apparatus for sizing and finishing lumber comprising:

sizing means including a first pair of opposed, power-driven belt abraders operable for receiving and dimensionally sizing the lumber to a first predetermined thickness by simultaneously abrading directly opposed areas on opposed, first and second lumber faces and conveying the lumber downstream and a second pair of opposed, power-driven belt abraders positioned downstream from said first pair of opposed belt abraders, said second pair being operable for receiving and dimensionally sizing the lumber, conveyed from said first pair of belt abraders, to a second predetermined thickness by simultaneously abrading directly opposed areas on the opposed, first and second lumber faces; and staggered finishing means including a first belt abrader which is power-driven and operable for receiving the lumber and finishing the first lumber face, a second belt abrader positioned downstream relative to said first belt abrader, said second belt abrader being power-driven and operable for receiving the lumber and finishing the second lumber face, a third belt abrader positioned downstream from said second belt abrader, said third belt abrader being power-driven and operable for receiving the lumber and final finishing the first lumber face and a fourth belt abrader positioned downstream from said third belt abrader, said fourth belt abrader being power-driven and operable for receiving the lumber and final finishing the second lumber face.

2. The apparatus of claim 1 wherein said third belt abrader is provided with an abrasive belt having a finer grit than said first belt abrader.

3. The apparatus of claim 2 wherein said fourth belt abrader is provided with an abrasive belt having a finer grit than said second belt abrader.

* * * * *